United States Patent [19]

Shortes et al.

[11] 4,086,980

[45] May 2, 1978

[54] DISMANTLING LADDER

[76] Inventors: Lois E. Shortes; Joan A. Shortes, both of 603 Canal St., Placerville, Calif. 95667

[21] Appl. No.: 767,779

[22] Filed: Feb. 11, 1977

[51] Int. Cl.[2] ..... E06C 1/08; E06C 7/50

[52] U.S. Cl. ..... 182/151; 182/178; 182/228

[58] Field of Search ..... 182/151, 178, 194, 228; 403/329

[56] References Cited

U.S. PATENT DOCUMENTS

| | | | |
|---|---|---|---|
| 1,220,792 | 3/1917 | Smith | 403/329 |
| 2,755,981 | 7/1956 | Edwards | 182/228 |
| 3,462,021 | 8/1969 | Hawke | 182/178 |

FOREIGN PATENT DOCUMENTS

| | | | |
|---|---|---|---|
| 755,786 | 11/1933 | France | 182/228 |
| 15,605 of | 1888 | United Kingdom | 182/151 |
| 972,322 | 10/1964 | United Kingdom | 182/228 |

*Primary Examiner*—Reinaldo P. Machado
*Attorney, Agent, or Firm*—Robert G. Slick

[57] ABSTRACT

A dismantling ladder is provided wherein the rails are made of different sizes with the rungs of a still smaller size so that one rail can be telescoped inside the other and a rung telescoped inside the smaller rail so that the ladder can be stored in minimum of space.

5 Claims, 4 Drawing Figures

DISMANTLING LADDER

SUMMARY OF THE INVENTION

The present invention relates to a dismantling ladder which can be stored in a minimum amount of space yet one which is very strong.

Although the ladder of the present invention was primarily designed for use by owners of mobile homes, it is obvious that the invention is one of wide applicability and can be used in any instance wherein it is desired to provide a strong ladder which can be disassembled and stored in a minimum amount of space.

Various ladders have been proposed in the past of a folding or telescoping nature but in each instance, the strength of the ladder depends on the fastening elements which hold the ladder in extended position. For instance, a number of ladders have been proposed having a pair of rails divided into sections wherein each section is smaller than the next lower so that a number of sections can be telescoped when the ladder is not in use. However, such ladders are dependent upon the snaps or clips which hold the rails in an extended position so that should these fastening means collapse, the ladder itself will collapse. Such unsafe structures have never been commercially successful because of this lack of safety. The ladder of the present invention can be stored in a much smaller space.

Further, with such telescoping ladders, the minimum dimension of the stored package is somewhat more than the height of one section and the width is as wide as the ladder itself.

Thus, the ladder of the present invention can be shipped and stored in a minimum amount of space yet it is extremely strong and does not depend on a fastening means for strength.

In contrast, the ladder of the present invention is extremely strong since the sections are held in an extended position by positive metallic stops and the clips which are employed merely hold the ladder together so that it can be readily moved without falling apart from one place to another. In other words, even if one of the clips failed, the ladder itself would not become unsafe.

Other objects and features of the invention will be brought out in the balance of the specification.

BRIEF DESCRIPTION OF THE DRAWINGS

In the drawings forming part of this application.

DESCRIPTION OF THE PREFERRED EMBODIMENTS

Figure 3:
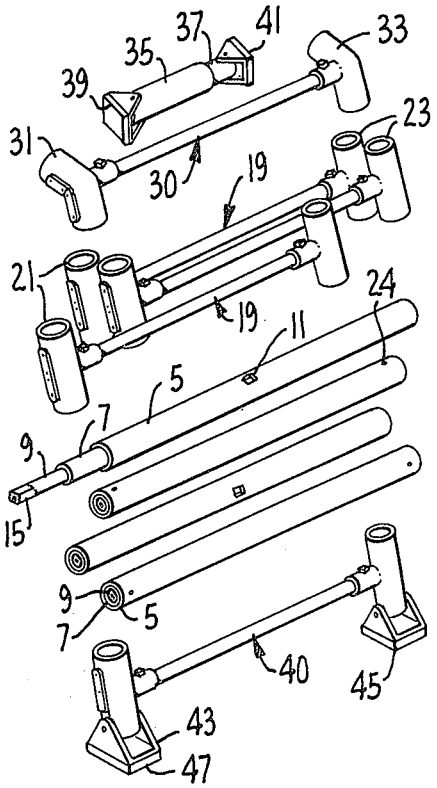
FIG. 3 is a perspective view of the disassembled parts employed in making the ladder of the present invention.
Figure 4:
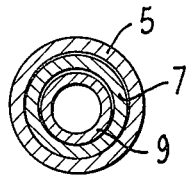
FIG. 4 is a section of a telescoped assembly, including two rails and a rung.

Referring now to the drawings by reference characters, the ladder of the present invention basically includes a plurality of large rails 5, a plurality of small rails 7, and a plurality of rungs 9. As is best seen in FIGS. 3 and 4, the inner diameter of a large rail 5 fits into the outer diameter of a smaller rail 7 and the inner diameter of the smaller rail 7 is such that it will accomodate the rung 9.

The rungs 9 fit into holes 11 and 13 in the rails 5 and 7 respectively. It will be noted that the holes 11 and 13 are somewhat square while the ends of the rungs have been flattened down as at 15 and 17 so that the rungs will not turn when they are stepped on.

In the embodiment of the ladder illustrated, the rails are shown as being two steps high although, of course, they could be of three steps or other multiples, depending upon the minimum height one had available for storage and shipment.

Figure 2:
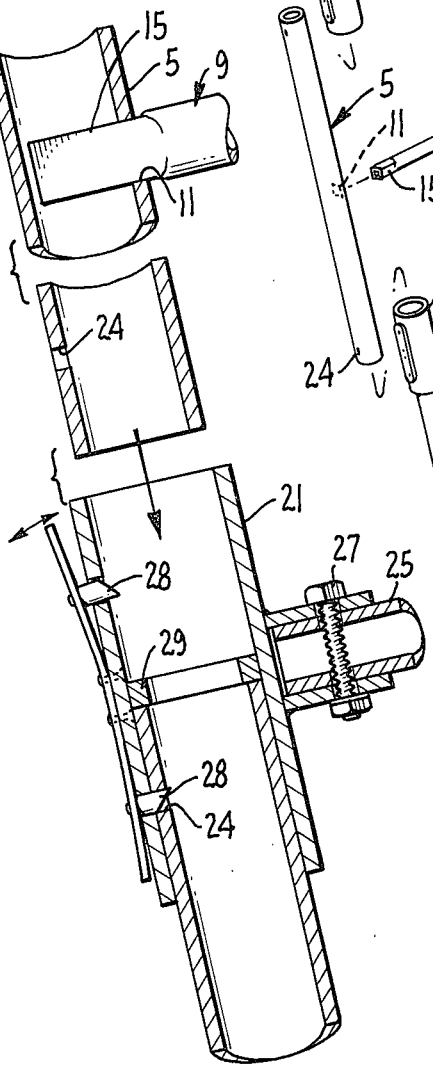
FIG. 2 is an enlarged section of one of the rails of the ladder.

Between adjacent sections of the rails are the connecting sections generally designated 19 and these consist of two T-shaped ends 21 and 23 with a rung 25 attached between them. Since these are not ordinarily disassembled, they can be permanently assembled by means of welding or by use of bolts as at 27. The T sections, as is most clearly seen in FIG. 2, have a collar 29 fixed, as by welding, on the inside, so that this collar supports the weight of adjacent sections. In addition, the rails are provided with a hole 24 which mates with a spring-mounted pin 28 to hold adjacent sections together. However, it will be apparent that the weight of the ladder, and anyone standing on the ladder, is borne by the collar 29 pressing against the next lower rail, so that the pins 28 are not relied upon to hold any weight but are merely used to facilitate movement and initial assembly of the ladder.

Figure 1:
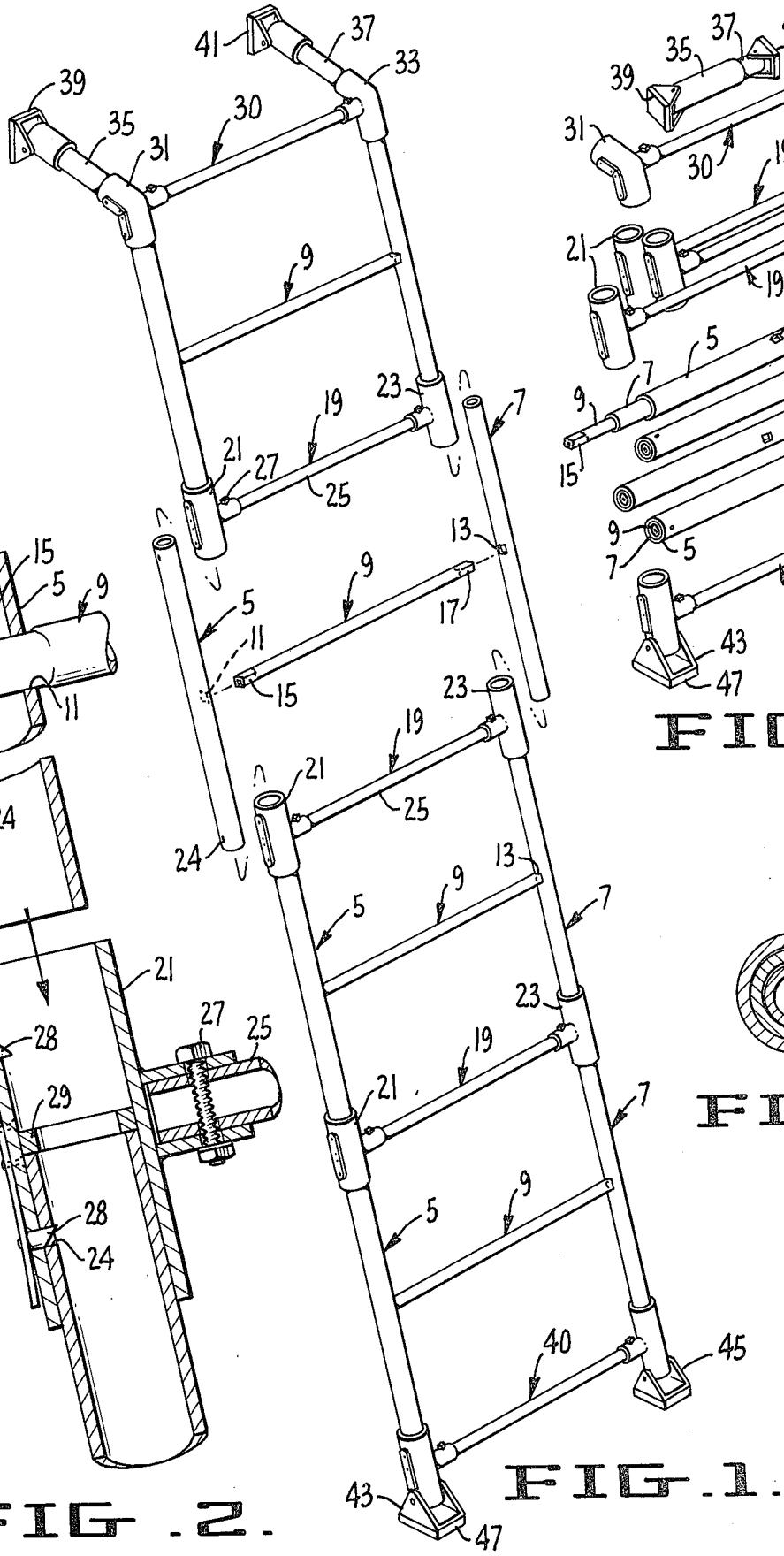
FIG. 1 is a perspective view of a ladder embodying the present invention.

In addition to the connecting sections such as those designated 19, special sections may be used at the top and the bottom, although they are not strictly necessary for the purposes of the present invention. As is shown in FIG. 1, section 30 has angling members 31 and 33 supporting short arms 35 and 37 which can be employed at the top of the ladder for the purpose of holding weight distributing feet 39 and 41. Such an upper terminating section may not be employed when the ladder is used for many purposes but it is likely desirable when it is used with an inherently weak structure such as a mobile home. In addition, a special bottom section 40 can be employed which is similar to that shown at 19 except that it has weight distributing feet 43 and 45, preferably provided with antifriction pads 47.

The ladder can easily be disassembled merely by pulling out on the springs holding the pins 25 and lifting the sections apart. This will produce the plurality of parts shown in FIG. 3. It will be noted that the short arm 37 telescopes within the short arm 35 while each of the rungs 9 fits inside of a small rail 7 which in turn fits inside of a large rail 5. Thus, the parts can be stored in a minimum of space and will occupy much less room than telescoping-type ladders.

Many variations can be made in the exact structure shown without departing from the spirit of this invention. For instance, a ladder with 9 rungs as shown and obviously the ladder can be made with any desired number of rungs. Further, the ladder is divided into sections, each twice as high as a single step, but the ladder can be divided into sections of three or even more steps. The holding devices have been shown as spring mounted pins but these are not essential to the operation of the ladder and merely serve as a convenience in assembling and moving the ladder. Any suitable locking device might be used. Although the rails and rungs have been shown to be round, they can be of any shape. For instance, they can be made of a series of concentric squares which would fit together. The connectors 21 have been shown as fitting outside the rails and they can just as easily fit inside of the hollow rails.

It is believed apparent from the foregoing that we have provided a dismantable ladder which is strong and can be easily disassembled and stored in a minimum of space.

We claim:

1. A dismantable ladder comprising in combination:

a. a plurality of pairs of rails, each pair comprising a large rail and a small rail, said small rail being of a size to telescope inside a large rail, b. a plurality of removable rungs, each removable rung being of a size to telescope inside a small rail, c. complementary holes in said rails to receive said rungs, and d. a plurality of connector elements, each connector element including a fixed rung with a double socket affixed to each end thereof, each of said double sockets having a first opening facing up and a second opening facing down, the sockets on one end having openings to receive a large rail and on the opposite end to receive a small rail, and a barrier with each of said sockets to prevent a rail from passing completely through the socket.

2. The structure of claim 1 wherein each socket is provided with a removable pin fitting into a mating hole in a rail to hold the rail in said socket.

3. The structure of claim 1 including at least one ladder end section having weight distribution feet thereon.

4. The structure of claim 1 wherein the rails and rungs are of circular cross section.

5. The structure of claim 1 wherein the holes in the rails and the ends of the rungs are of non-circular shape whereby the rung cannot turn in the holes.

* * * * *